US007891405B2

(12) United States Patent
Xu et al.

(10) Patent No.: US 7,891,405 B2
(45) Date of Patent: Feb. 22, 2011

(54) WATER-COOLING MOLD FOR METAL CONTINUOUS CASTING

(75) Inventors: Rongjun Xu, Shanghai (CN); Xiao Liu, Shanghai (CN); Yongquan Li, Shanghai (CN); Jian Cui, Shanghai (CN)

(73) Assignee: Baoshan Iron and Steel Co., Ltd., Shanghai (CN)

( * ) Notice: Subject to any disclaimer, the term of this patent is extended or adjusted under 35 U.S.C. 154(b) by 567 days.

(21) Appl. No.: 10/585,963

(22) PCT Filed: Sep. 20, 2004

(86) PCT No.: PCT/CN2004/001063

§ 371 (c)(1),
(2), (4) Date: Jul. 14, 2008

(87) PCT Pub. No.: WO2005/075131

PCT Pub. Date: Aug. 18, 2005

(65) Prior Publication Data

US 2008/0283213 A1 Nov. 20, 2008

(30) Foreign Application Priority Data

Jan. 17, 2004 (CN) ..... 2004 1 0015897

(51) Int. Cl.
*B22D 11/04* (2006.01)
*B22D 11/055* (2006.01)

(52) U.S. Cl. ..... 164/418; 164/443

(58) Field of Classification Search ..... 164/443, 164/485, 418, 459

See application file for complete search history.

(56) References Cited

U.S. PATENT DOCUMENTS

| | | | |
|---|---|---|---|
| 5,460,220 | A | 10/1995 | Coassin |
| 5,927,378 | A | 7/1999 | Grove et al. |
| 5,941,298 | A | 8/1999 | Pleschiutschnigg |
| 6,186,220 | B1 | 2/2001 | Sucker et al. |

(Continued)

FOREIGN PATENT DOCUMENTS

| | | |
|---|---|---|
| CN | 1121851 | 5/1996 |

OTHER PUBLICATIONS

International Search Report for International Application PCT/CN2004/001063 dated May 19, 2005.

*Primary Examiner*—Kevin P Kerns
(74) *Attorney, Agent, or Firm*—Hamre, Schumann, Mueller & Larson, P.C.

(57) ABSTRACT

A water-cooled mold for continuous casting includes two water-cooled wide copper plates arranged opposite to each other in a front and back direction and two water-cooled narrow copper plates arranged opposite to each other in a left and right direction. The upper portion of the cavity of the mold is a sprue area and the lower portion of the cavity is a mold cavity area. The sprue area is gradually narrowed in the casting direction and smoothly transited into the mold cavity, corresponding to the shape of a slab to be cast. The inside surfaces of the water-cooled narrow copper plates are smooth planar surfaces. A portion of the inside surface of the water-cooled wide copper plates in the sprue area is a curved surface and another portion in the mold cavity area is a planar surface. The curved surface and the planar surface portions form a continuous smooth surface.

10 Claims, 12 Drawing Sheets

U.S. PATENT DOCUMENTS 6,390,177 B1 * 5/2002 Arvedi et al. ..... 164/418
6,474,401 B1 * 11/2002 Streubel ..... 164/418
2002/0000305 A1 1/2002 Sucker et al.
2004/0256078 A1 * 12/2004 Pleschiutschnigg et al. . 164/455

* cited by examiner

WATER-COOLING MOLD FOR METAL CONTINUOUS CASTING

TECHNICAL FIELD

The present invention relates to a water-cooled mold for continuous metal casting, particularly to a water-cooled mold for use in thin-metal-slab continuous casting (TCC).

DESCRIPTION OF THE PRIOR ART

The configuration and dimensions of the curved surfaces of the copper plates of a TCC mold are mainly determined by the cross-section of the cast slab, as well as the shape, dimensions and submerged depth of a submerged nozzle.

A slab is subject to both shrinkage and deformation of cross-section thereof in casting direction because of the curved surfaces of the copper plates of a TCC mold. Consequently, unlike a common mold of parallel plate type, the shell of a slab, when it passes though the curved surfaces of the copper plates of a mold, is forced to undertake additional deformation, which may cause a defect in the cast slab.

As is well known, unlike a mold of flat plate type in which shrinkage of a slab can be compensated for by adjusting an inclination or taper of the narrow copper plates of the mold, in a TCC mold with curved-surface copper plates, a shrinkage curve in the casting direction is very important. By properly designing both horizontal and vertical profiles of curved surfaces of copper plates so as to allocate deformation which will be experienced by a slab, a defective slab may be avoided.

The shrinkage of the circumference of a cross section profile curve of the cavity of a TCC mold in a casting direction must be equal or a little less than solidification shrinkage of a slab shell. If the former is more than the latter, the slab shell shall be subject to additional deformation, uniform contact between the slab shell and the inside wall of the TCC mold cannot be attained, the temperature in some areas of the slab shell may be overly high or overly low, and there is a potential increase for the slab shell to develop cracks; or a drag against pulling the slab may be overly large, or even the slab shell may be pulled or broken, which will result in an uneven wear of the TCC mold and a reduced lifecycle of the copper plates of the same. If the former is far less than the latter, an overly large clearance may occur between the slab shell and the inside walls of the TCC mold, which may lead to an increased heat transfer resistance and cause that a slab shell which has already solidified be melted again, and thus the slab may have defects due to thermal stress.

Several TCC molds are disclosed in patent documents CN 95106714.1, EP 0552501 and DE 3907351A1. In the molds of these patents, the upper portion of water-cooled wide copper plates has an inclined smooth surface and the lower portion is a vertical planar surface; the upper portion of the mold is a sprue area and the lower portion is a funnel-shaped cavity. A horizontal cross section curve of a wide side is composed of three alternating arc lines which are connected tangentially end to end (the three arc lines may or may not have outside tangents line segment), and the curvature radius at points on the three arcs is gradually increased from up to down.

Several sprue configurations of TCC molds are disclosed in CN98126914.1 and CN98125062.9. In these two patents, it is mainly taken into account to improve a shrinkage curve in the casting direction of a TCC mold by means of designing vertical profile of the cavity under the case that the horizontal profile of the cavity of the wide copper plates of a TCC mold is predetermined. It is recommended by the patents that the parallel portions of the profile from the upper opening of a TCC mold to the lower opening thereof may be a convex curve or a combined curve which is composed of concave and convex curves, and it is proposed that the combined curve be composed of some arc lines or triangle-like (e.g. sinusoidal) curves.

In the above-mentioned TCC mold, although smoothness of both horizontal and vertical profile curves of the cavity of a TCC mold is taken into account, only the first derivative of the curves are continuous (i.e. curves are tangential with each other and a curve is tangential with a linear line), and the tangent points are still singular points and stress concentration points. A slab shell is unavoidably subject to some stresses during its solidification in a TCC mold and moving downwards, therefore, cracks may occur in the slab shell.

The funnel-shaped TCC molds of the prior art have the following drawbacks.

1. There exist stresses both in horizontal and vertical directions in a thin slab.
2. Surfaces of the slab shell trends to have cracks because the cavity configuration of a TCC mold causes stresses in the solidified slab shell, with the crack occurrence rate being up to 2% (including longitudinal and transverse cracks).
3. As there are stresses both in horizontal and vertical directions in a thin slab, the kind of steels that can be continuously cast is limited. For example, peritectic steel cannot be cast.
4. A TCC mold experiences a local and uneven wear so that its lifecycle is reduced.
5. Operation cost of a TCC mold is higher.

SUMMARY OF THE INVENTION

The object of the invention is to provide a TCC mold that overcomes the above-mentioned problems in the prior art, produces a slab with good surface quality, eliminates slab surface defects, reduces uneven wear of the mold and has an extended lifecycle.

The above object is to be achieved by the following technical means.

A water-cooled mold for continuous casting, comprising two water-cooled wide copper plates which are arranged opposite to each other in front and back direction and two water-cooled narrow copper plates which are arranged opposite to each other in left and right direction, so that all the four plates form a cavity of said mold; an upper portion of a cavity of the mold being a sprue area and a lower portion of the cavity being a mold cavity area, the sprue area being gradually narrowed in a casting direction and smoothly transited into the mold cavity, which corresponds to a shape of a slab to be cast; an inside surface of each of the water-cooled narrow copper plates being a smooth planar surface; a portion of an inside surface of each of the water-cooled wide copper plates that is in the sprue area being a curved surface, and a portion of the inside surface that is in the mold cavity area being a planar surface, the curved surface portion and the planar surface portion forming a continuous smooth surface; and a central point $O_1$, (See FIG. 1) of a top face of the mold being an intersection point of a central axis of the mold with the top face of the sprue area, the curved surface portions of the cavity surfaces of the water-cooled wide copper plates are formed of such points P that they are intersection points of first curves and second curves, wherein the first curves are located in horizontal cross sections at different heights of the central axis of the mold, and are left-right symmetrical, a distance from a peak point of every first curve to the central axis being H+h, and a distance from a valley point of every first curve to the central axis being h; every first curve is composed of a curve segment in the middle and two linear segments at two opposite ends adjacent to the water-cooled narrow copper plates, each of the two linear segments having a length $1_0$, and the curve segment having a width L with two opposite end-points, p and q; wherein the second curves are located in longitudinal sections parallel to the water-cooled narrow plates, every second curve is composed of an upper inclined linear segment with a slope k, a middle curve segment with a connection point m to the inclined linear segment, and a lower vertical linear segment parallel to the central axis with a length $d_0$ and a connection point n to the curve segment; in the mold, every second curve has an overall height $D+d_0$, and a distance between point m and point n projected on the central axis is d (See FIG. 2); wherein the first curves meet the following equation:

$$f(x) = \sum_{i=0}^{n} a_i x^i$$

where n has a minimum value of 6, $a_i = f_i(H, L)$; $f_i$ meets that the second derivatives at points p and q are continuous; wherein the second curves meet the following equation:

$$f(z) = \sum_{j=0}^{m} b_j z^j$$

where m has a minimum value of 5, $b_j = f_{ij}$ (D, d, k); $f_{ij}$ meets that the second derivatives at points m and n are continuous.

The TCC mold of the invention has the following advantages over the prior art.

1. A local stress concentration of the shell of a slab during its movement deformation and shrinkage can be avoided, because the curvature at any points in the curved surface, including curved portion and planar portion, of the cavity of the wide copper plates of the TCC mold is varied continuously.

2. Deformation resistance to the solidified slab shell is reduced to even smaller, because the overall length of the profile curves in horizontal cross sections of the cavity of the upper sprue area of the water-cooled wide copper plates at different heights of the TCC mold is gradually reduced from up to down, and comply with the solidification shrinkage of the slab shell.

3. When the TCC mold of the invention is used in a metal continuous casting, the slab shell is hardly apt to crack.

4. When the TCC mold of the invention is used in a metal continuous casting, the copper plates are hardly to experience uneven wear and therefore their lifecycle can be lengthened.

5. The TCC mold can be not only used to cast common steels, but also used to cast the steels that have an excessive shrinkage in their solidification, such as peritectic steel and austenitic stainless steel.

Figure 1:
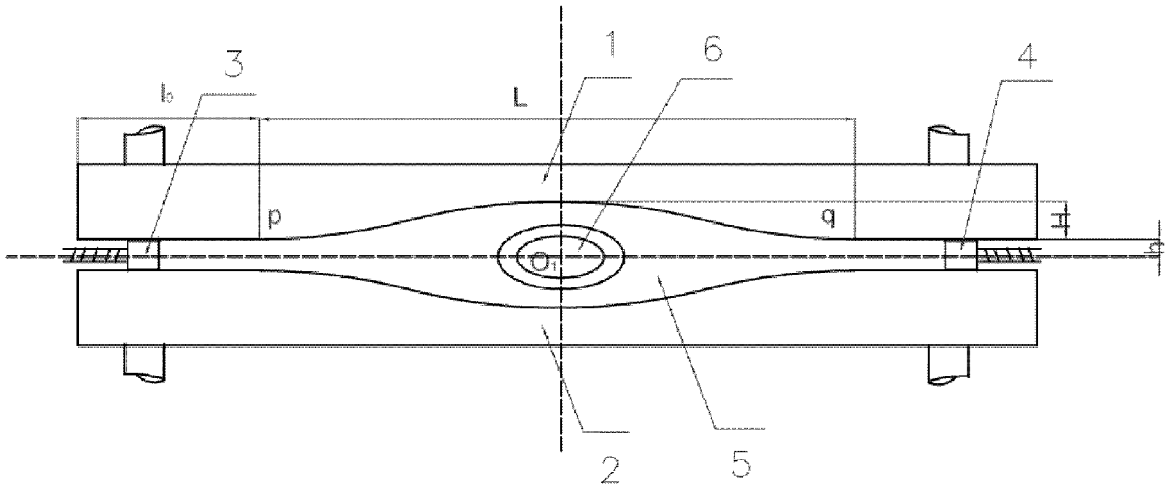
FIG. 1 is a plan view of a TCC mold according to the present invention.

In the drawings, reference numbers denote:

1, 2 water-cooled wide copper plates

3, 4 water-cooled narrow copper plates

5 casting sprue area

6 submerged nozzle

7 lower cavity area

θ the biggest inclination angle of inclined curved surfaces

DETAILED DESCRIPTION OF THE INVENTION

The invention now is described in detail in a preferred embodiment in reference to the drawings for better understanding its method, features and effects.

Figure 2:
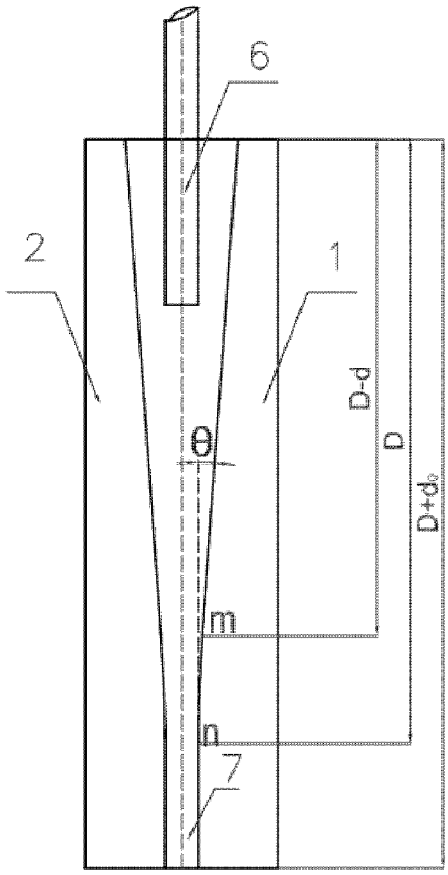
FIG. 2 is a side view of a TCC mold according to the present invention.

Referring to FIGS. 1 and 2, the TCC mold of the invention is composed of two water-cooled wide copper plates 1, 2 which are opposite to each other in front and back direction and two water-cooled narrow copper plates 3, 4 which are opposite to each other in right and left direction. The water-cooled wide copper plates 1, 2 both include an upper portion and a lower portion. The two lower portions have vertical planar surfaces with a space between them (they are the planar portions of the lower portions of the water-cooled wide copper plates), nevertheless, the vertical planar surfaces can be omitted. The two upper portions have inclined curved surfaces which are open upwards and outwards with a biggest inclination angle θ being less than 12°. The two water-cooled narrow copper plates 3, 4 are flat plates opposite to each other. All the wide and narrow copper plates form an upper casting sprue 5 and a lower mold cavity 7. In addition, there is provided a submerged nozzle 6.

The inside profile curve of the casting sprue 5 in a horizontal section at any height of each water-cooled wide copper plate 1, 2 is composed of a curve segment in the middle and two linear segments at opposite ends, or composed of only a curve segment. Throughout the inside profile curve (including linear segments) in any horizontal section, the first derivative, second derivative and curvature of the curve are all varied continuously. The inside profile curve in a vertical section of the casting sprue 5 at any transverse position of each water-cooled wide copper plate 1, 2 is composed of a curve segment in the middle, an upper inclined linear segment connected to the upper end of the curve segment and a lower vertical linear segment connected to the lower end of the curve segment. Optionally, the lower vertical linear segment can be omitted. Throughout the inside profile curve (including linear segments) in any vertical section, the first derivative, second derivative and curvature of the curve are all varied continuously. That is, at any point of the curved surfaces (including curved surfaces and planar surfaces) of the inside profile of the wide copper plates of a TCC mold of the invention, curvature is varied continuously. The overall length of an inside profile curve in a horizontal section of the casting sprue 5 at any height of each water-cooled wide copper plate 1, 2 is gradually reduced in an up-to-down direction, which complies with the solidification shrinkage of the shell of the slab.

The surface configuration and its design method of the water-cooled wide copper plates of a TCC mold of the invention are described below in detail.

Figure 3:
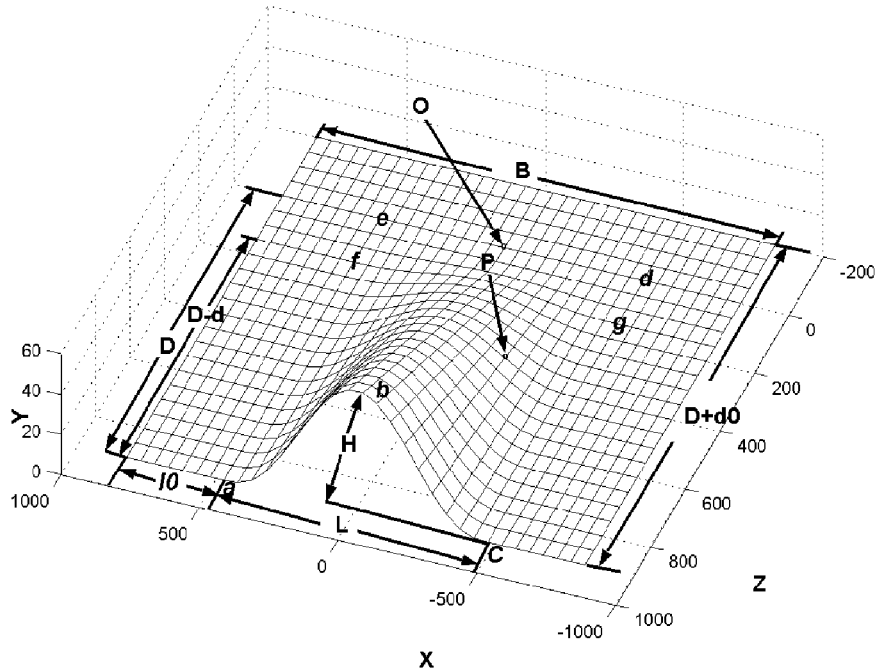
FIG. 3 shows a grid formation of a curved surface of the cavity between two wide copper plates of a TCC mold according to the invention.

Referring to FIG. 3, the area encircled by letters a, b, c, g, d, e and f is a curved surface area of the water-cooled wide copper plate of a TCC mold, and the remainder is a planar surface area. The area encircled by letters a, c, g and f is a curved surface area of the wide copper plates of the TCC mold, which is in the vertical direction and formed of linear lines. The area encircled by letters g, d, e and f is a curved surface area of the wide copper plates of the TCC mold, which is in the vertical direction and formed of curves. H is the biggest opening height of the TCC mold, L is an opening length of the TCC mold, D is the biggest height at which the curved surface of the sprue in vertical direction of the TCC mold is terminated, D−d is the height of the sprue curved surface in the vertical direction of the TCC mold, which is formed of linear lines, $D+d_0$ is an overall height of the TCC mold, B is an overall width of the TCC mold. For a simpler manufacture process, in determining a surface configuration of water-cooled wide copper plates, the midpoint O of segment de is selected as the coordinate origin. The three-dimensional model function can be solved by converting it into a two-dimensional function, and then treated by superposition.

Figure 4:
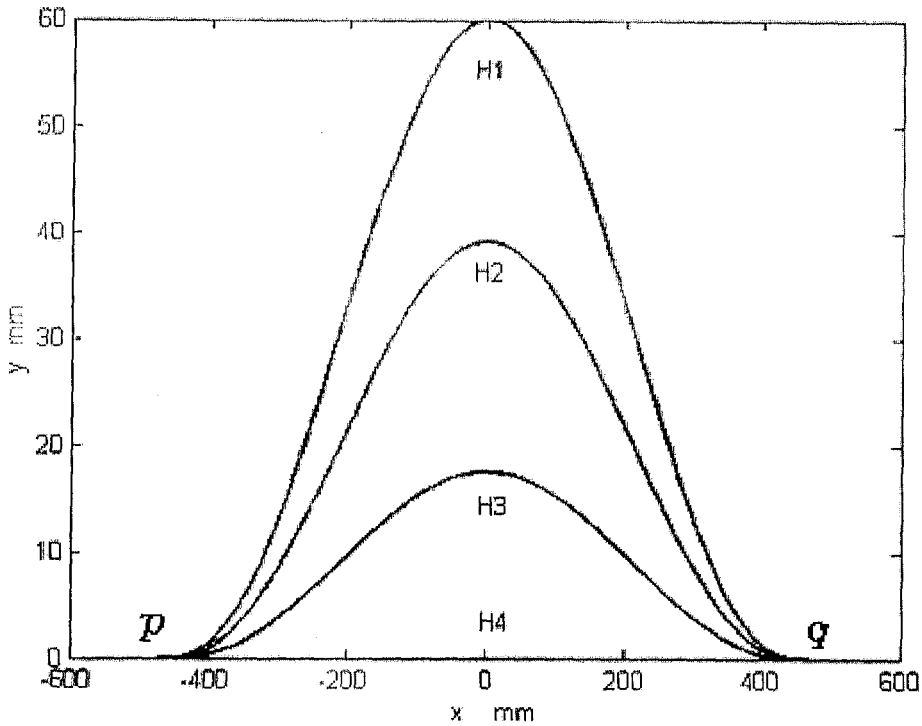
FIG. 4 shows horizontal cross section curves (arbitrary section) of the cavity between two wide copper plates of a TCC mold according to the invention.
Figure 21:
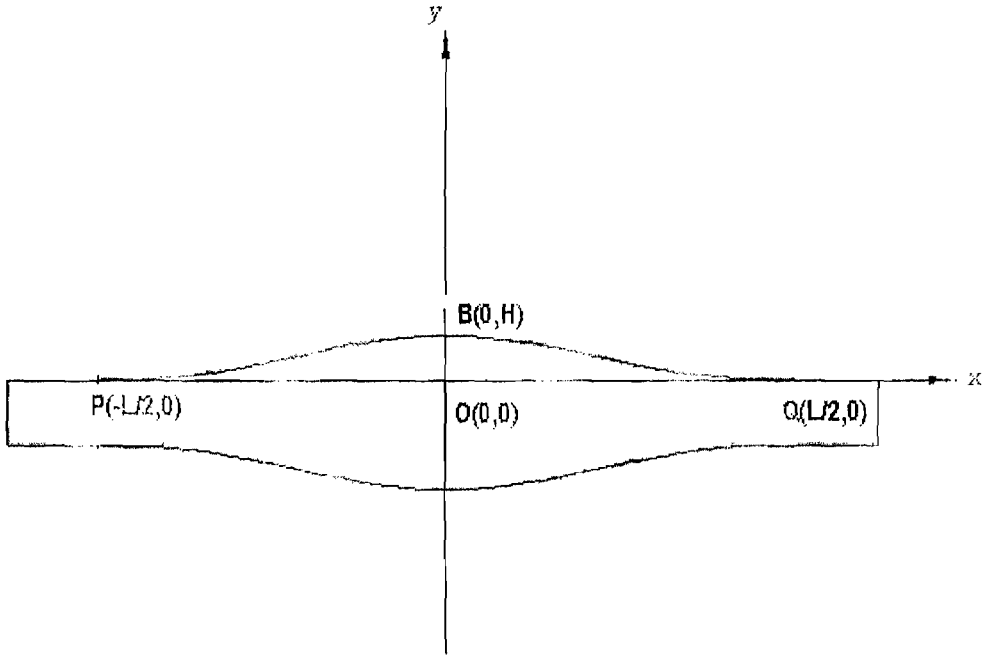
FIG. 21 shows the first coordinate in a horizontal section of a TCC mold of the invention.

A coordinate system as shown in FIGS. 4 and 21 is established for inside profile curves in a horizontal direction of a TCC mold. The inside profile curve of the casting sprue in a horizontal section at any height of each water-cooled wide copper plate 1, 2 is composed of a curve segment in the middle and two linear segments at opposite ends. An intersection point of a vertical line at the position of ½ opening width on the curved segment in x direction and a horizontal linear line connecting the two ends of the curved segment in y direction is taken as a coordinate origin. The equation is constrained by the conditions: at points p and q which are the connection points of a curve and a linear line, its assignment in y direction is the same as that for a linear segment; its first derivative and second derivative are the same as those for a linear segment; at the position of ½ opening width on the curved segment in x direction, there is a maximum H in y direction, and its first derivative is zero. For example, in the case that the opening length L in x direction is required in processing to be 900 mm, a maximum H in y direction is 50 mm. According to the above constraints, it can be derived that an equation $y=-6.02\times10^{-15}x^6+3.66\times10^{-9}x^4-7.41\times10^{-4}x^2+50$ for a profile curve in horizontal direction of the upper sprue of a TCC mold. Thereby it is possible to make the curvature of the inside profile curve of the casting sprue in a horizontal section at any height of each water-cooled wide copper plate 1 or 2 be varied continuously, that is, curvatures at the connection points of curves and linear lines are equal.

Figure 8:
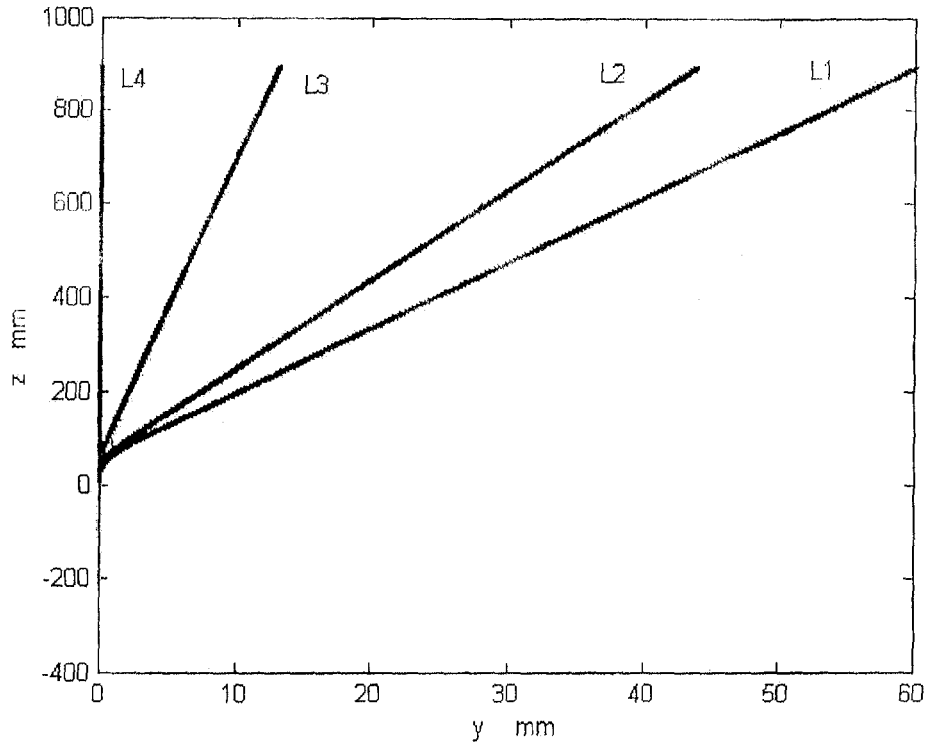
FIG. 8 shows vertical section curves (arbitrary section) of the cavity between two wide copper plates of a TCC mold according to the invention.
Figure 22:
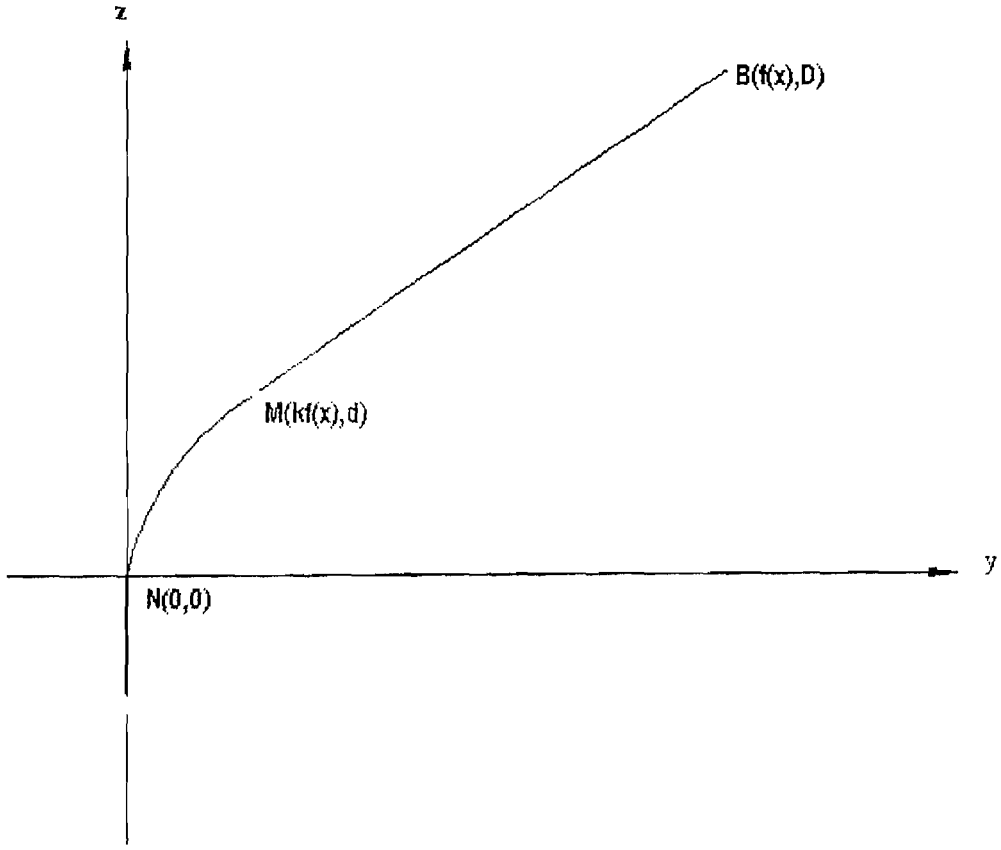
FIG. 22 shows the first coordinate in a vertical section of a TCC mold of the invention.

A coordinate system as shown in FIGS. 8 and 22 is established for inside profile curves in a horizontal direction of a TCC mold. The inside profile curve of the casting sprue in a vertical section at any transverse position of each water-cooled wide copper plate 1, 2 is composed of a curve segment in the middle, an upper inclined linear segment connected to the upper end of the curve segment and a lower vertical linear segment connected to the lower end of the curve segment. The lower endpoint of the curve segment is taken as a coordinate origin. This equation is constrained by the conditions: at points m and n which are the connection points of a curve and a linear line, its assignment in y direction is the same as that for a linear segment; and its first derivative and second derivative are the same as those for a linear segment. The overall depth D is taken to be 700 mm, the depth d at which the linear segment of the sprue terminates is taken to be 100 mm. Assuming that the height of the sprue in y direction is expressed by kf(x) after the linear segment terminates, the height in y direction on a TCC mold is expressed by f(x), and k is assigned by 0.12, if f(x) at the center of the curve on a TCC mold is assigned by 50 mm, then the curve segment in vertical direction at the center of the sprue of a TCC mold can be expressed by equation $y=1.40\times10^{-9}z^5-3.87\times10^{-7}z^4+3.07\times10^{-5}z^3$, and the inclined linear segment connected to the upper end of the curve segment can be expressed by equation $y=7.33\times10^{-2}z-1.33$. Therefore, the curvature of the inside profile curve (including linear segment) in a vertical section of the casting sprue at any transverse position of each water-cooled wide copper plate can be made be varied continuously.

Figure 23:
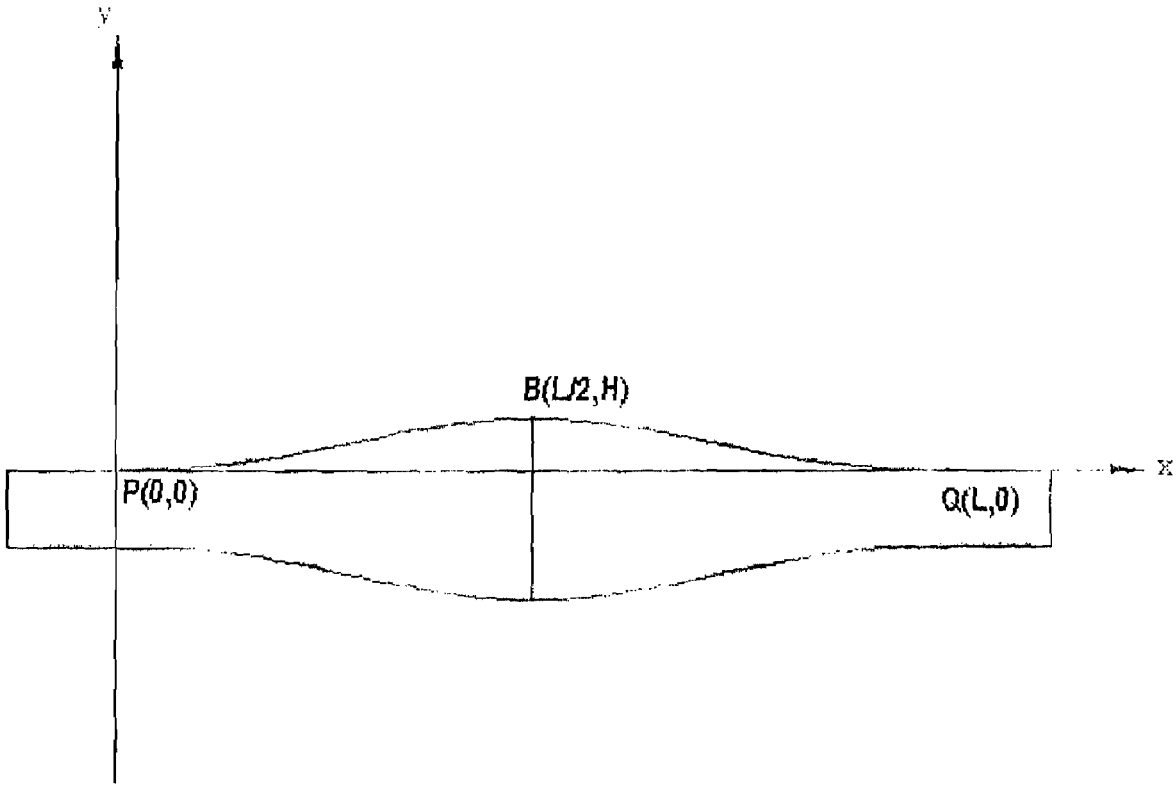
FIG. 23 shows the second coordinate in a horizontal section of a TCC mold of the invention.

If a different coordinate is established, the functional equations derived from the above analysis may have some changes. Nevertheless, the functional equations will still be in the form that $y=a_0+a_1x+a_2x^2+a_3x^3+a_4x^4+a_5x^5+a_6x^6$, and $y=b_0+b_1z+b_2z^2+b_3z^3+b_4z^4+b_5z^5$. Now, it is explained only by an example in which a different coordinate is established to solve the inside profile curves in different horizontal cross sections of the sprue portion of the water-cooled wide copper plates. Referring the coordinate as shown in FIG. 23, a maximum H in y direction is 50 mm, and the opening length L in x direction is 900 mm. According to the constraints that the second derivatives at points p and q which are intersection points of a curve and two linear lines must be continuous, an equation $y=-6.02\times10^{-15}x^6+1.63\times10^{-11}x^5-1.46\times10^{-8}x^4+4.39\times10^{-6}x^3$ is derived.

It can be known from the above detailed description and comparison with reference to the drawings, a TCC mold can be improved in its performance greatly if the second derivative of the profile curves of its cavity is varied continuously. Furthermore, if the third derivative, fourth derivative and even higher order derivatives of the profile curves are required to be continuous, it is possible to determine polynomials of even higher order as equations for the curve segment of the profile curves. Now, it is explained only by an example in which the connection points (points p and q) of the curve segment with the two linear segments of the profile curves in any horizontal section of the cavity of water-cooled wide copper plates of a TCC mold meet that their third derivative are continuous. Referring to the coordinate as shown in FIGS. 4 and 23, a maximum H in y direction is 50 mm, and the opening length L in x direction is 900 mm. According to the constraints that the third derivatives at points p and q must be continuous, an equation $y=2.97\times10^{-20}x^8-2.41\times10^{-14}x^6+7.32\times10^{-9}x^4-9.88\times10^{-4}x^2+50$ is derived.

In FIG. 4, H1, H2, H3 and H4 are opening width in y direction at different heights of a TCC mold. The curves are each composed of a curve segment in the middle and two linear segments at both ends or composed of only a curve. In the case there is not any linear segment, it is still possible to determine the profile curves by use of the above method, but it needs to suppose that linear lines are connected to both ends of the curve.

Figure 5:
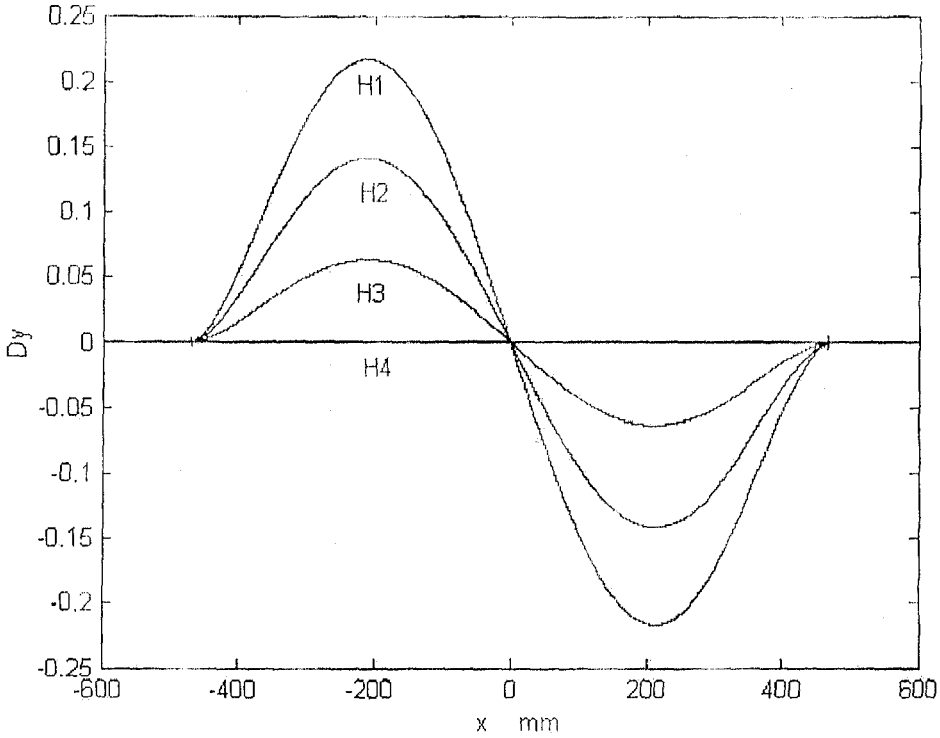
FIG. 5 shows the first derivative curves of the horizontal cross section curves (corresponding to the curves in FIG. 4) of the cavity between two wide copper plates of a TCC mold according to the invention, the first derivative curves being continuous on the whole profile.

Referring to FIG. 5, the first derivatives of the profile curves (corresponding to the curve in FIG. 4) in horizontal direction of the cavity of the water-cooled wide copper plates of a TCC mold is varied continuously.

Figure 6:
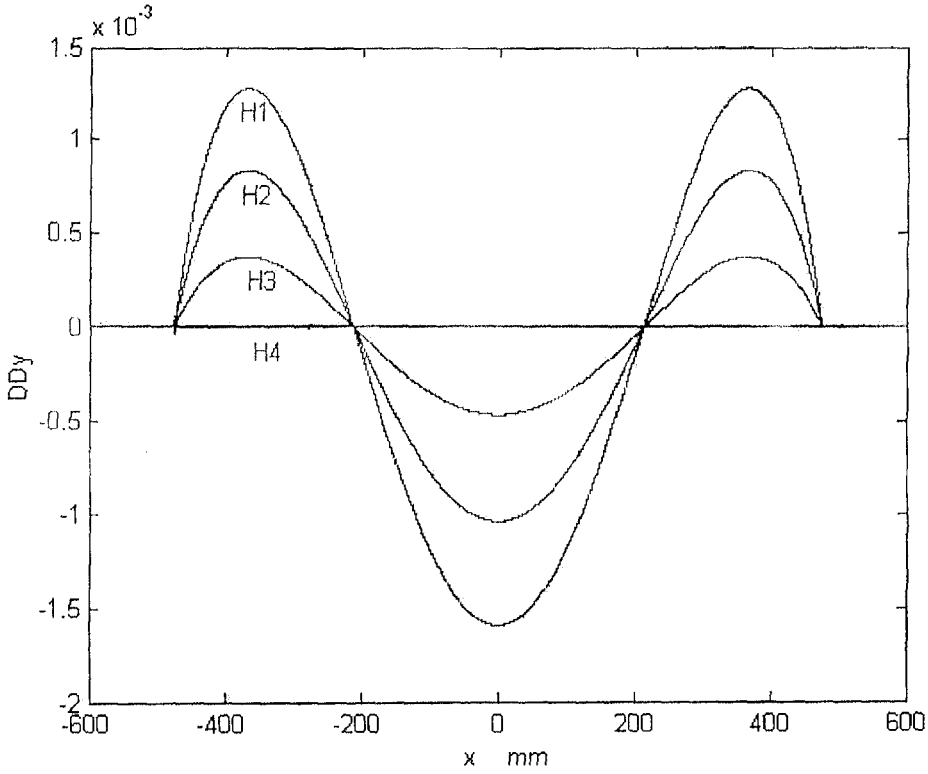
FIG. 6 shows the second derivative curves of the horizontal cross section curves (corresponding to the curves in FIG. 4) of the cavity between two wide copper plates of a TCC mold according to the invention, the second derivative curves being continuous on the whole profile.

Referring to FIG. 6, the second derivative of the profile curves (corresponding to the curve in FIG. 4) in horizontal direction of the cavity of the water-cooled wide copper plates of a TCC mold is varied continuously.

Figure 7:
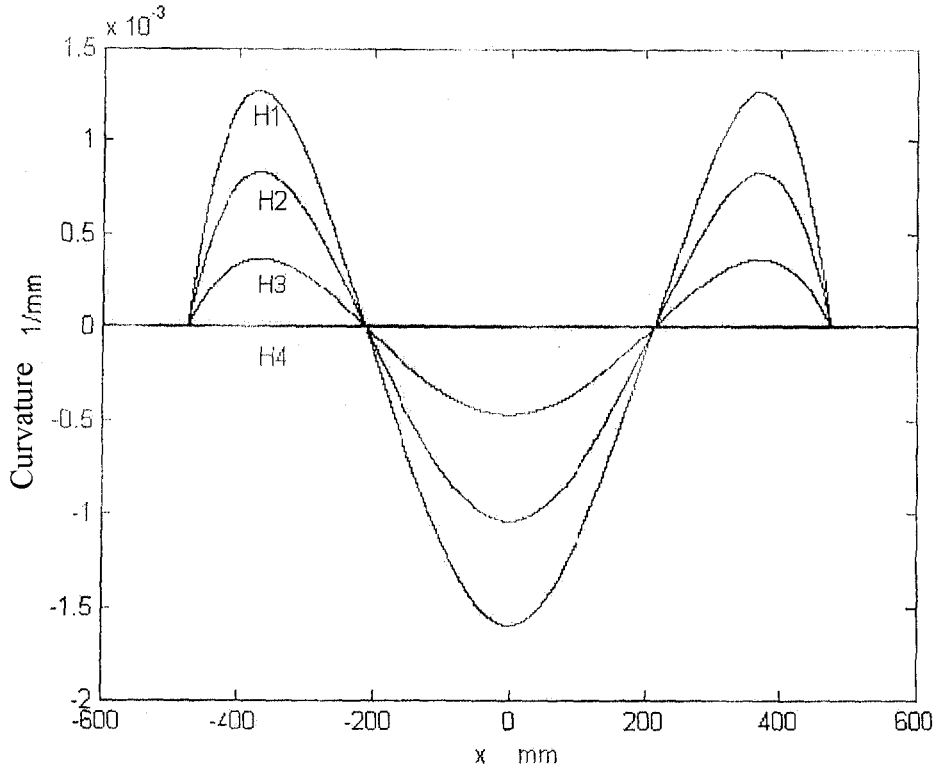
FIG. 7 shows the curves of curvature variation of the horizontal cross section curves (corresponding to the curves in FIG. 4) of the cavity between two wide copper plates of a TCC mold according to the invention, the curvature being continuous on the whole profile.

Referring to FIG. 7, the curvature of the profile curves (corresponding to the curve in FIG. 4) in horizontal direction of the cavity of the water-cooled wide copper plates of a TCC mold is varied continuously.

In FIG. 8, L1, L2, L3 and L4 are opening length between two different positions in transverse direction of a TCC mold. The curves are composed of a curve segment in the middle, an upper inclined linear segment connected to the upper end of the curve segment and a lower vertical linear segment connected to the lower end of the curve segment. Optionally, the lower vertical linear segment connected to the lower end of the curve segment can be omitted. In the case there is not the lower vertical linear segment, it is still possible to determine the profile curves by use of the above method, but it needs to suppose that a lower vertical linear segment is connected.

Figure 9:
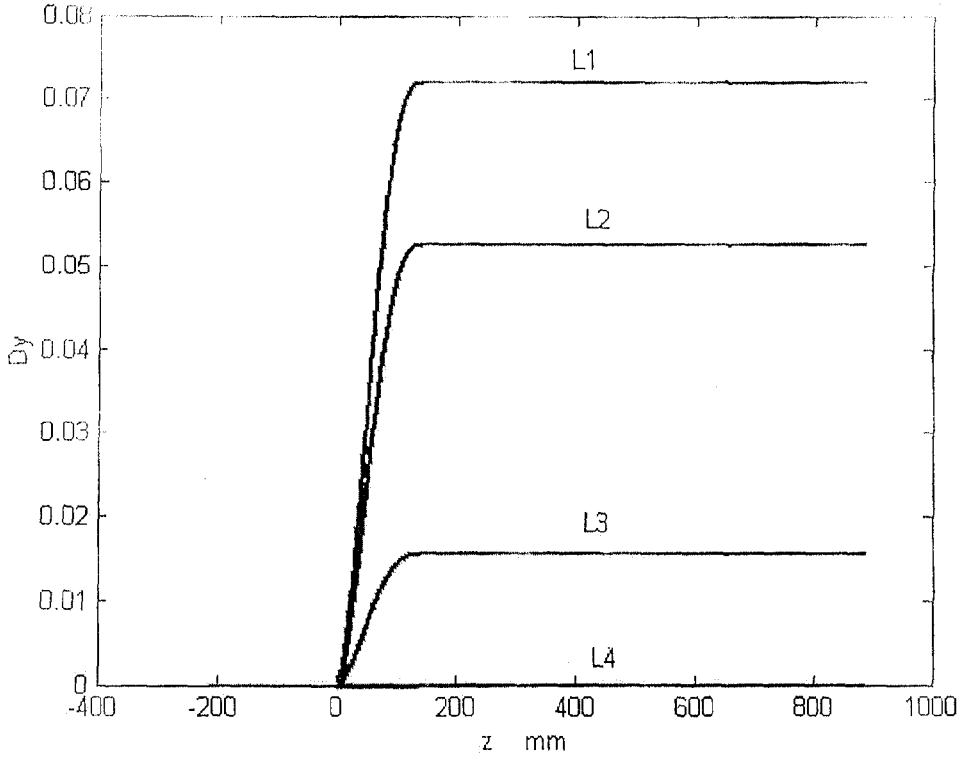
FIG. 9 shows the first derivative curves of the vertical section curves (corresponding to the curves in FIG. 8) of the cavity between two wide copper plates of a TCC mold according to the invention, the first derivative curves being continuous on the whole profile.

Referring to FIG. 9, the first derivatives of the profile curves (corresponding to the curve in FIG. 8) in vertical direction of the cavity of the water-cooled wide copper plates of a TCC mold is varied continuously.

Figure 10:
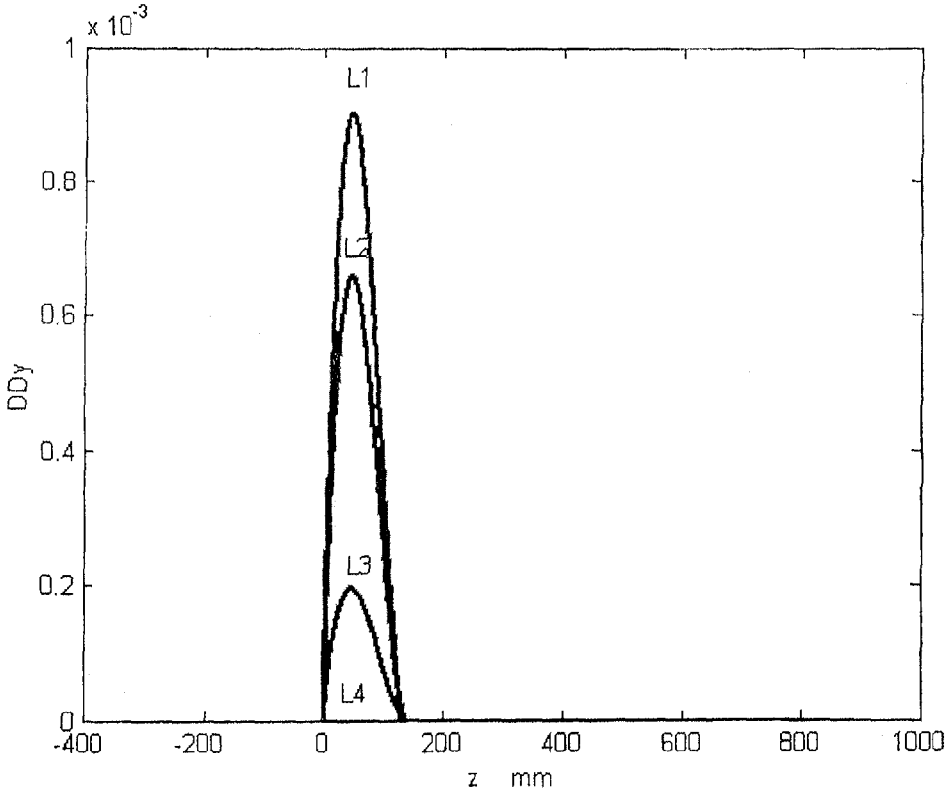
FIG. 10 shows the second derivative curves of the vertical section curves (corresponding to the curves in FIG. 8) of the cavity between two wide copper plates of a TCC mold according to the invention, the second derivative curves being continuous on the whole profile.

Referring to FIG. 10, the second derivatives of the profile curves (corresponding to the curve in FIG. 4) in vertical direction of the cavity of the water-cooled wide copper plates of a TCC mold is varied continuously.

Figure 11:
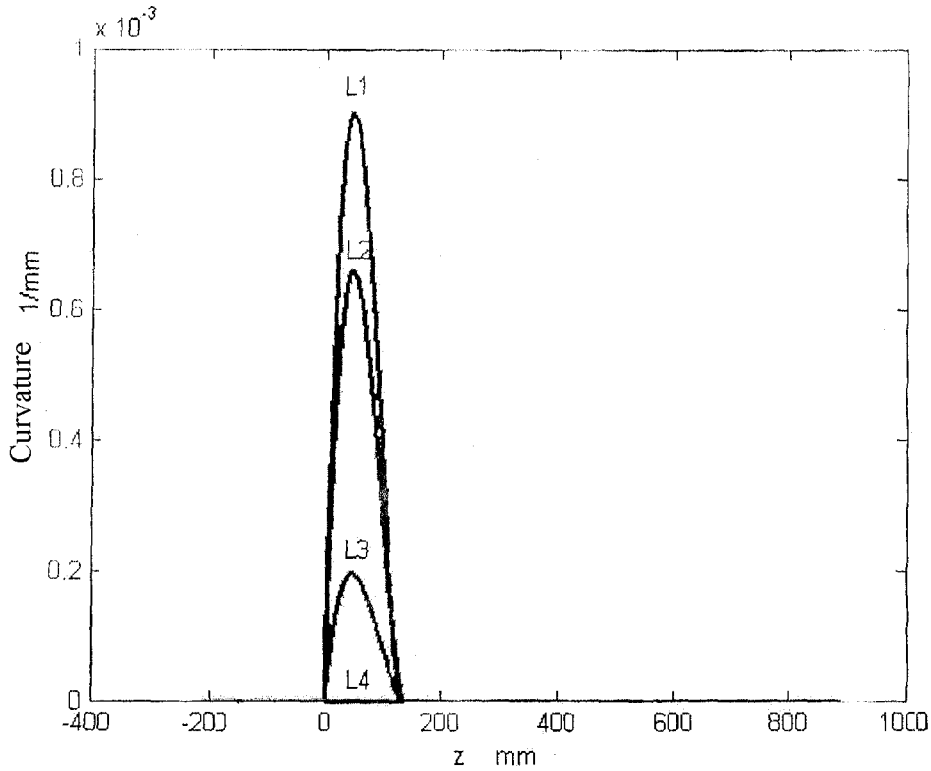
FIG. 11 shows the curves of curvature variation of the vertical section curves (corresponding to the curves in FIG. 4) of the cavity between two wide copper plates of a TCC mold according to the invention, the curvature being continued on the whole profile.

Referring to FIG. 11, the curvature of the profile curves (corresponding to the curve in FIG. 4) in vertical direction of the cavity of the water-cooled wide copper plates of a TCC mold is varied continuously.

Figure 12:
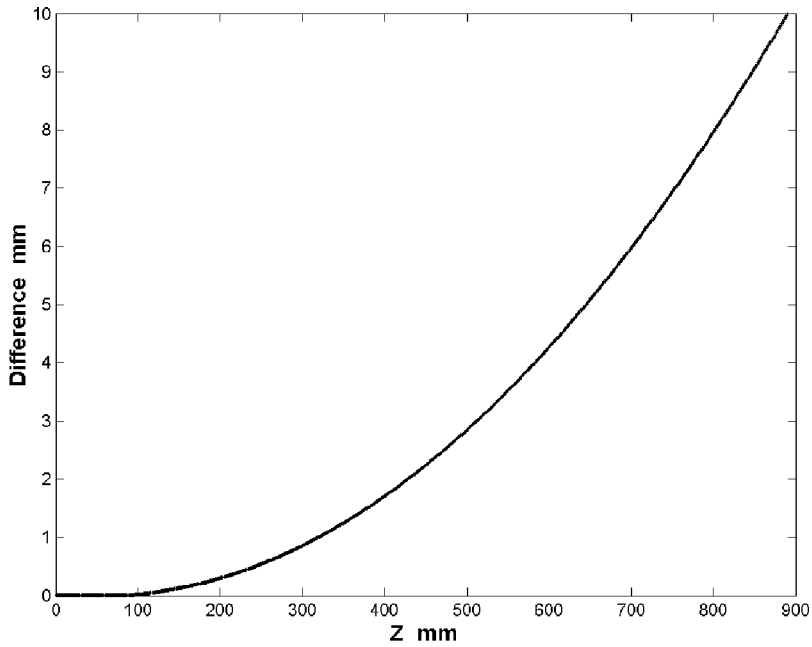
FIG. 12 shows a difference between arc section and linear section of a profile curve of a cavity of a TCC mold (along different heights of a TCC mold)

Referring to FIG. 12, it can be seen that the difference between curve segment and linear segment (at different heights of a TCC mold) of the profile curves of the cavity of a TCC mold is gradually reduced from up to down, and so is the overall length of curves, and that the length variation of the profile curves of horizontal cross sections in height direction of a TCC mold is in the form of a curved uneven shrinkage, complying with the solidification shrinkage of a slab shell.

Figure 13:
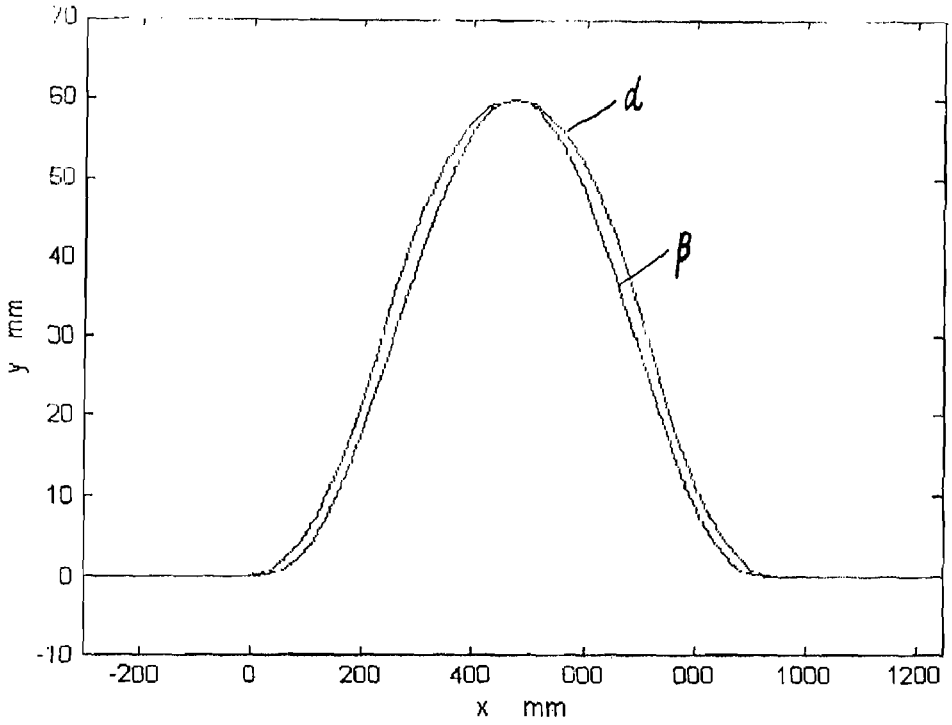
FIG. 13 shows a comparison between an upper port curve of a TCC mold of the invention and the same of the prior art (in the horizontal direction)
Figure 14:
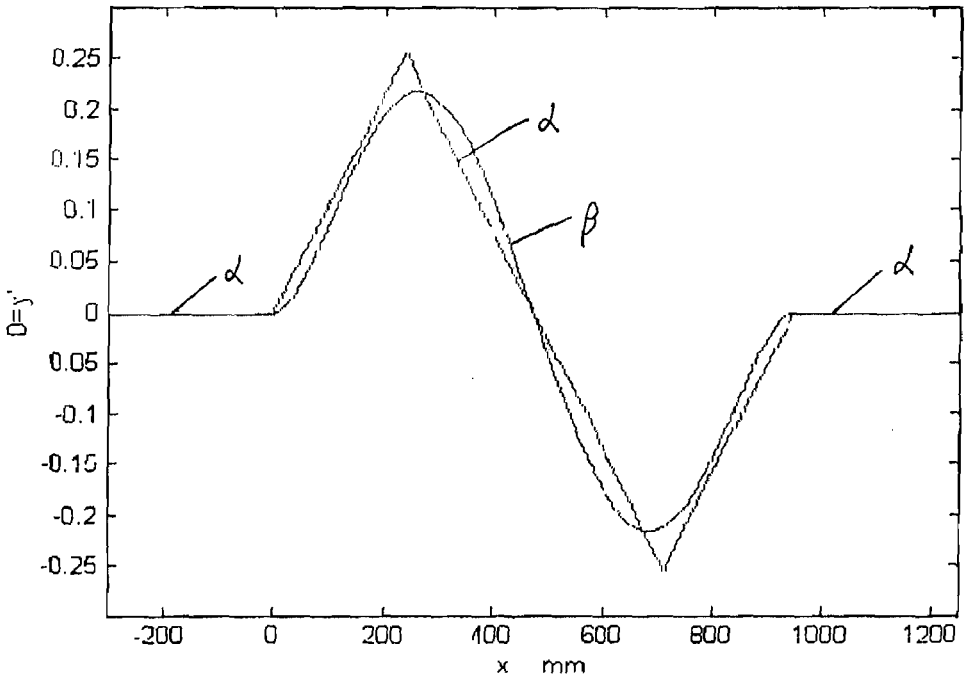
FIG. 14 shows a comparison between the first derivative of an upper port curve of a TCC mold of the invention and the same of the prior art (in horizontal direction)
Figure 15:
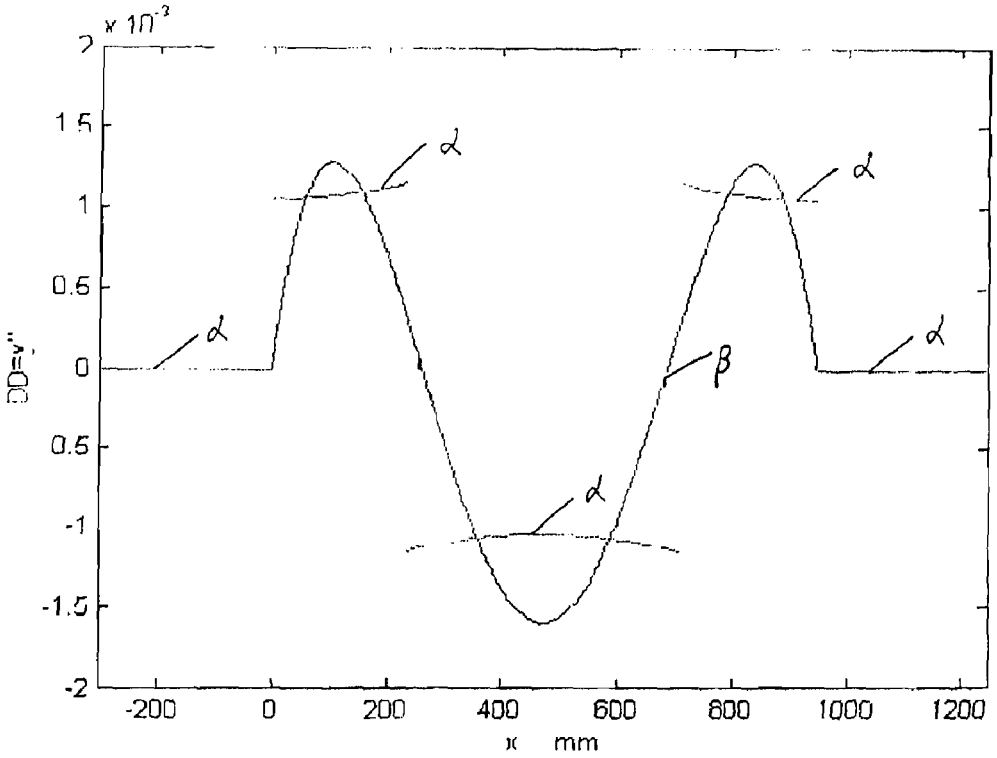
FIG. 15 shows a comparison between the second derivative of an upper port curve of a TCC mold of the invention and the same of the prior art (in horizontal direction)
Figure 16:
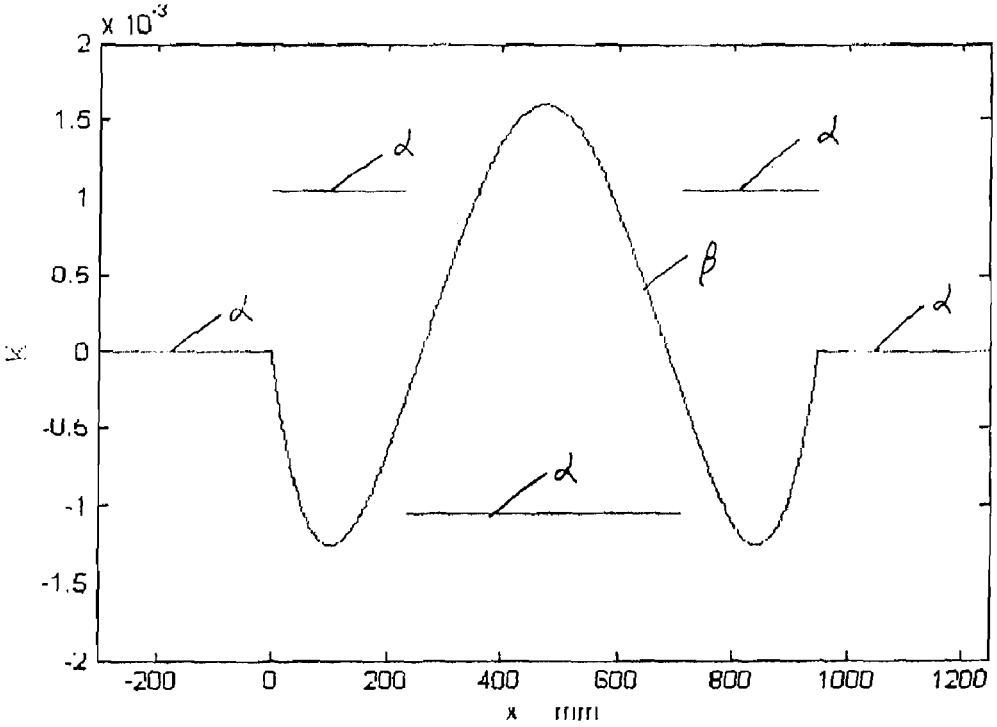
FIG. 16 shows a comparison between the curvature of an upper port curve of a TCC mold of the invention and the same of the prior art (in horizontal direction)

In FIG. 13, a comparison of the upper opening curves in horizontal direction between a TCC mold of the prior art and a TCC mold of the invention is shown. In the figure, $\alpha$ denotes the prior art, and $\beta$ denotes the present invention. This also applies to FIGS. 14-20. In FIG. 14, a comparison of the first derivatives of upper opening curves in horizontal direction between a TCC mold of the prior art and a TCC mold of the invention is shown. In FIG. 15, a comparison of the second derivatives of upper opening curves in horizontal direction between a TCC mold of the prior art and a TCC mold of the invention is shown. In FIG. 16, a comparison of the curvatures of upper opening curves in horizontal direction between a TCC mold of the prior art and a TCC mold of the invention is shown.

Figure 17:
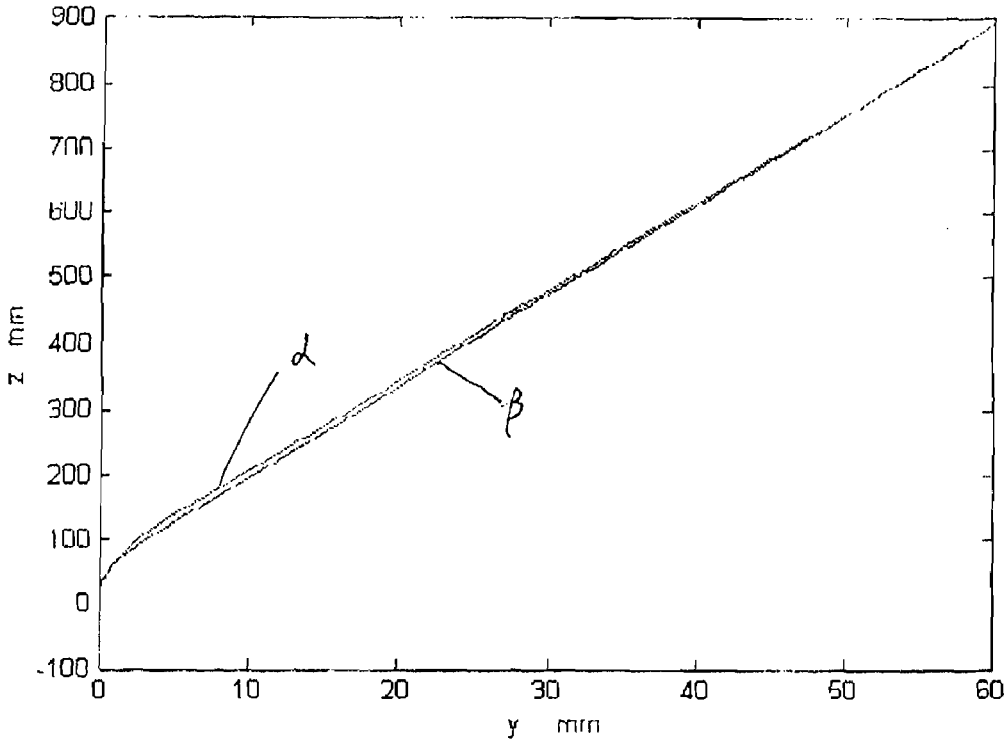
FIG. 17 shows a comparison between the central curve of a TCC mold of the invention and the same of the prior art (in vertical direction)
Figure 18:
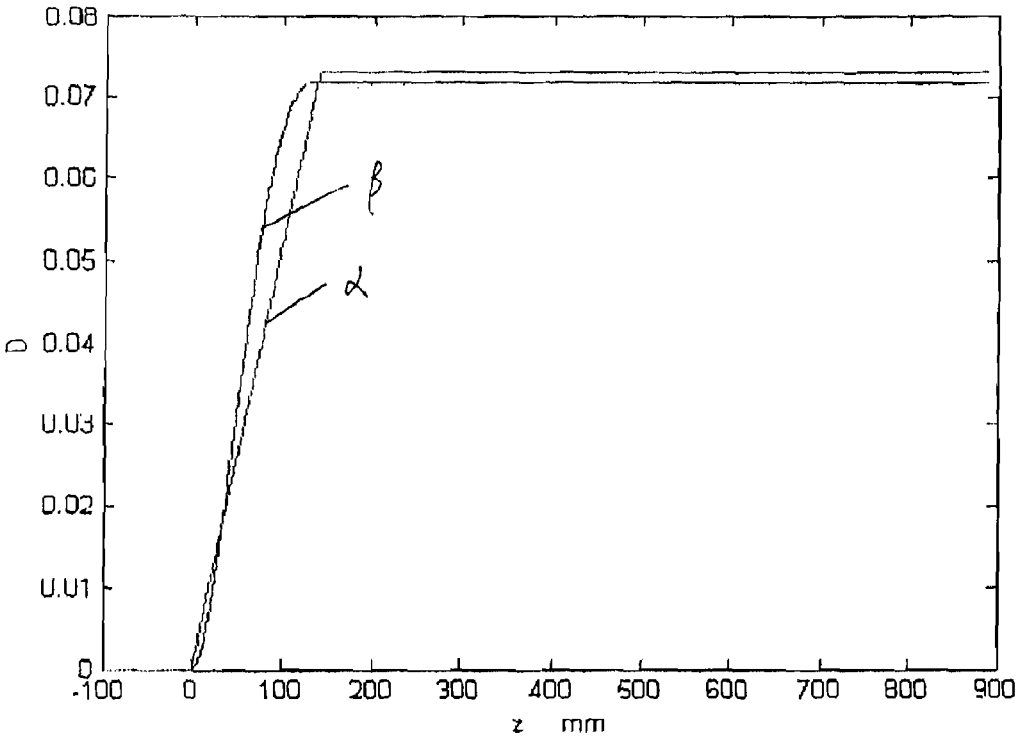
FIG. 18 shows a comparison between the first derivative of the central curve of a TCC mold of the invention and the same of the prior art (in vertical direction)
Figure 19:
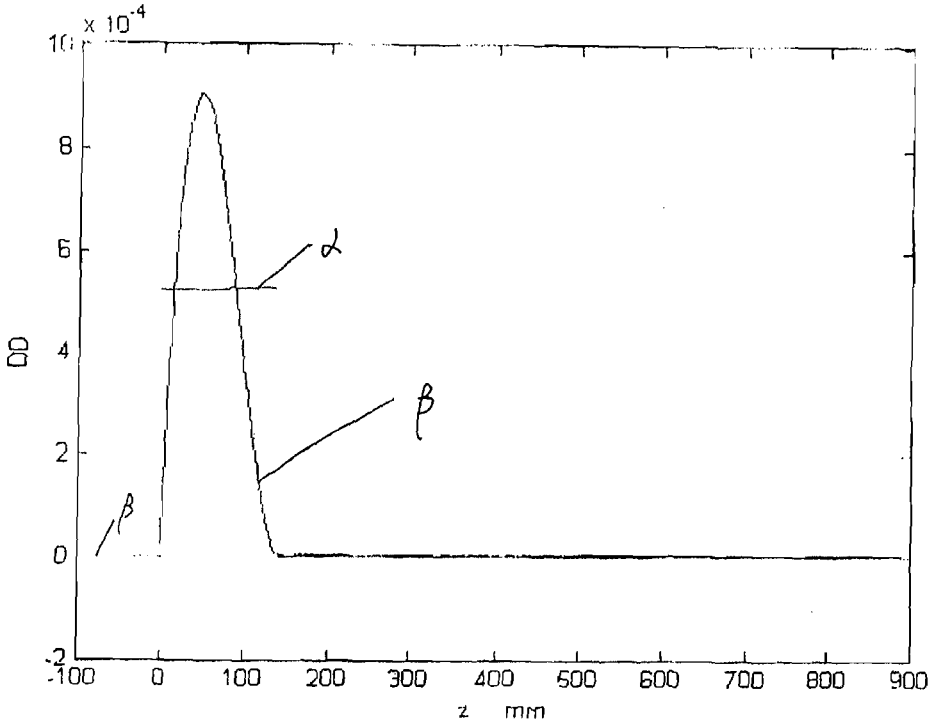
FIG. 19 shows a comparison between the second derivative of the central curve of a TCC mold of the invention and the same of the prior art (in vertical direction)
Figure 20:
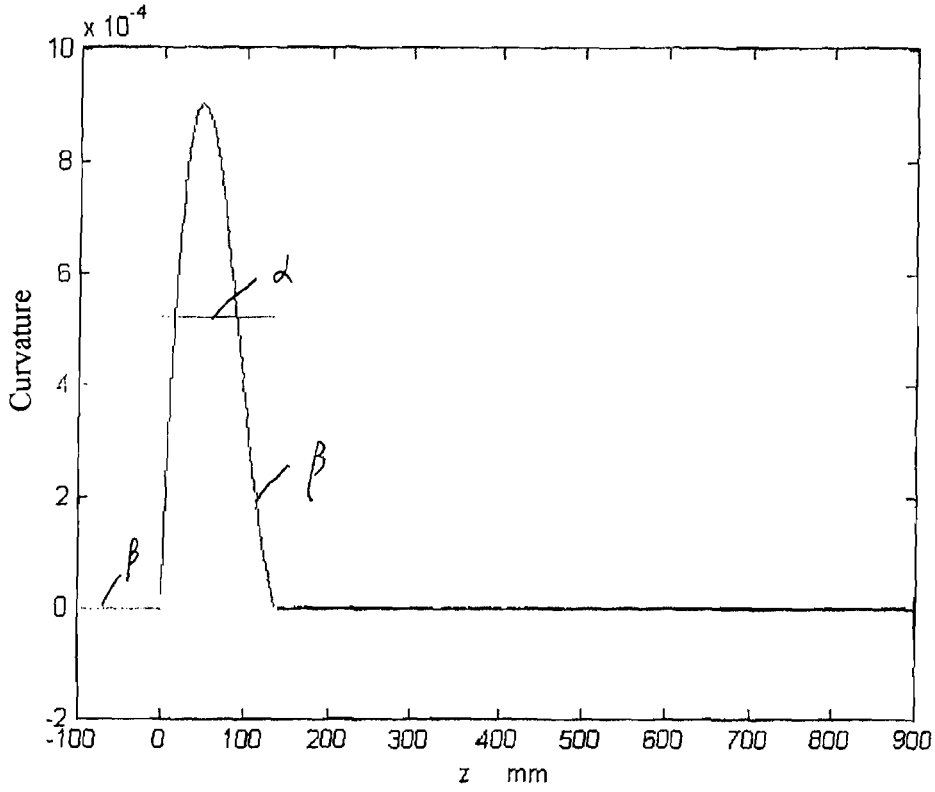
FIG. 20 shows a comparison between the curvature of the central curve of a TCC mold of the invention and the same of the prior art (in vertical direction)

Similarly, in FIG. 17, a comparison of the central curves in vertical direction between a TCC mold of the prior art and a TCC mold of the invention is shown. In FIG. 18, a comparison of the first derivatives of central curves in vertical direction between a TCC mold of the prior art and a TCC mold of the invention is shown. In FIG. 19, a comparison of the second derivatives of central curves in vertical direction between a TCC mold of the prior art and a TCC mold of the invention is shown. In FIG. 20, a comparison of the curvatures of central curves in vertical direction between a TCC mold of the prior art and a TCC mold of the invention is shown. As can be seen from these figures, for the profile curves of the cavity curved surfaces of a TCC mold of the prior art, only the first derivative of them is varied continuously, whereas for the profile curves of the cavity curved surfaces of a TCC mold of the invention, both the first derivative and the second derivative thereof are varied continuously. This contributes to solve the technical problems in the prior art as mentioned above.

Preferably, a ratio of the length of a profile curve of a horizontal cross section of the upper opening of a TCC mold to the length of linear lines connected to two ends of the curve is selected to be between 1.02 and 1.15. And, the length variation of the profile curves of horizontal cross sections in height direction of a TCC mold is in the form of curvedly and unevenly shortening.

Preferably, the ratio of the upper opening width between two narrow water-cooled copper plates to the lower opening width of them is selected to be 1.0-1.05.

In a process for implementing the present invention, firstly, two wide water-cooled copper plates and two narrow water-cooled copper plates are manufactured in accordance with the configuration and dimension requirements for a TCC mold of the invention, and then, the four water-cooled copper plates are assembled together in a proper interrelation, so that a TCC mold is ready for use.

It should be understood that the above description of the preferred embodiment is illustrative and exemplary and is in no way intended to limit the scope of the present invention. Any modifications, variations and equivalents without departing from the spirit of the invention all fall into the scope of the invention claimed in the Claims.

The invention claimed is:

1. A water-cooled mold for continuous metal casting, comprising two water-cooled wide copper plates which are arranged opposite to each other in a front-and-back direction and two water-cooled narrow copper plates which are arranged opposite to each other in a right-and-left direction, the two water-cooled narrow copper plates and the two water-cooled wide copper plates each having an inside surface, these inside surfaces altogether defining a cavity of the mold; an upper portion of the cavity of the mold being a sprue area and a lower portion of the cavity being a mold cavity area, the sprue area being gradually narrowed in a casting direction and smoothly transited into the mold cavity area, which corresponds to a shape of a slab to be cast; the inside surface of each of the water-cooled narrow copper plates being a smooth planar surface; a portion of the inside surface of each of the water-cooled wide copper plates that is in the sprue area being a curved surface, and a portion of the inside surface that is in the mold cavity area being a planar surface, the curved surface portion and the planar surface portion forming a continuous smooth surface; and a central point ($O_1$) of a top face of the mold being an intersection point of a central axis of the mold with the top face of the sprue area, wherein the inside surface of a selected one of the water-cooled wide copper plates is formed of such points (P) that they are intersection points of first curves and second curves, the points (P) having three dimensional coordinate values x, y and z in a three dimensional coordinate system with the X axis lying in the planar surface portion of the inside surface of the selected water-cooled wide copper plate and parallel to the top face of the mold, the Y axis parallel to the water-cooled narrow copper plates and the top face of the mold, and the Z axis parallel to the central axis, wherein with respect to the selected water-cooled wide copper plate, the first curves are located in horizontal cross sections at different heights of the central axis of the mold, and are left-right symmetrical about the central axis, a distance from a peak point of every first curve to the central axis in the direction of the Y axis being H+h, and a distance from a valley point of every first curve to the central axis in the direction of the Y axis being h; every first curve is composed of a curve segment in the middle and two linear segments at two opposite ends adjacent to the water-cooled narrow copper plates, each of the two linear segments having a length $l_0$ in the direction of the X axis, and the curve segment having a width L in the direction of the X axis with two opposite endpoints (p, q);

wherein with respect to the selected water-cooled wide copper plate, the second curves are located in longitudinal sections parallel to the water-cooled narrow plates, every second curve is composed of an upper inclined linear segment having an upper endpoint and a lower endpoint, with a ratio k of a distance from the lower endpoint to the planar surface portion of the inside surface of the selected water-cooled wide copper plate to a distance from the upper endpoint to said planar surface portion, a middle curve segment with a connection point (m) to the inclined linear segment, and a lower vertical linear segment parallel to the central axis with a length $d_0$ in the direction of the Z axis and a connection point (n) to the curve segment; every second curve has an overall height $D+d_0$, and a distance between the two connection points (m, n) projected on the central axis is d;

wherein with respect to the selected water-cooled wide copper plate, the curve segment of every first curves meets the following equation:

$$y = f(x) = \sum_{i=0}^{n} a_i x^i$$

where n has a minimum value of 6, $a_i=f_i(H, L)$; $f_i$ meets that the second derivatives at the endpoints (p, q), of the curve segment are continuous;

wherein with respect to the selected water-cooled wide copper plate, the curve segment of every second curves meets the following equation:

$$y = f(z) = \sum_{j=0}^{m} b_j z^j$$

where m has a minimum value of 5, $b_j=f_j(D, d, k, f(x))$; $f_j$ meets that the second derivatives at the connection points (m, n) are continuous.

2. The water-cooled mold for continuous metal casting according to claim 1, wherein $l_0$ is 0.

3. The water-cooled mold for continuous metal casting according to claim 1, wherein $d_0$ is 0.

4. The water-cooled mold for continuous metal casting according to claim 1, wherein the curve segment of every first curve for the selected water-cooled wide copper plate is expressed by the equation: $f(x)=a_0+a_1x+a_2x^2+a_3x^3+a_4x^4+a_5x^5+a_6x^6$.

5. The water-cooled mold for continuous metal casting according to claim 1, wherein the curve segment of every second curve for the selected water-cooled wide copper plate is expressed by the equation: $f(z)=b_0+b_1z+b_2z^2+b_3z^3+b_4z^4+b_5z^5$.

6. The water-cooled mold for continuous metal casting according to claim 1, wherein third and higher order derivatives at the endpoints (p , q) are continuous.

7. The water-cooled mold for continuous metal casting according to claim 1, wherein third and higher order derivatives at the connection points (m, n) are continuous.

8. The water-cooled mold for continuous metal casting according to claim 1, wherein a ratio of the length of a profile curve of a horizontal cross section of an upper opening of the mold to the length of the linear lines which adjoin the two opposite ends of the curve is selected to be between 1.02 and 1.15, and the length variation of the profile curves of horizontal cross sections in the height direction of the mold is in the form of curvedly and unevenly shortening.

9. The water-cooled mold for continuous metal casting according to claim 1, wherein an inclination angle at which the upper portion of each water-cooled wide copper plate opens upwards and outwards is less than 12°.

10. The water-cooled mold for continuous metal casting according to claim 1, wherein a ratio of an upper opening width to a lower opening width of each of the two narrow water-cooled copper plates is selected to be 1.0-1.05.

* * * * *